US009141041B2

(12) United States Patent
Kishi

(10) Patent No.: US 9,141,041 B2
(45) Date of Patent: Sep. 22, 2015

(54) IMAGE FORMING APPARATUS

(71) Applicant: CANON KABUSHIKI KAISHA, Tokyo (JP)

(72) Inventor: Takehiro Kishi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/597,681

(22) Filed: Jan. 15, 2015

(65) Prior Publication Data

US 2015/0205231 A1 Jul. 23, 2015

(30) Foreign Application Priority Data

Jan. 22, 2014 (JP) ..... 2014-009545

(51) Int. Cl.
*G03G 15/16* (2006.01)

(52) U.S. Cl.
CPC ..... *G03G 15/1615* (2013.01)

(58) Field of Classification Search
CPC ..... G03G 15/1605; G03G 15/1615
USPC ..... 399/66, 302, 395
See application file for complete search history.

(56) References Cited

U.S. PATENT DOCUMENTS 8,867,961 B2 10/2014 Nakazato
2012/0082489 A1* 4/2012 Shirakata ..... 399/302
2014/0369721 A1* 12/2014 Miyazawa et al. ..... 399/302

FOREIGN PATENT DOCUMENTS

JP 2000-034031 A 2/2000
JP 2013-003381 A 1/2013

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes a stretch roller and a steering roller rotatably supporting an intermediate transfer belt and a control portion executing a meandering control operation of controlling a widthwise position of the intermediate transfer belt by operating a tilting portion tilting the steering roller. The control portion tilts the steering roller to a reference position when transfer biases are applied to first and second transfer members in forming an image to perform the meandering control operation from the reference position. The control portion is also configured to be able to update the reference position stored in a storage portion based on an inclined position of the steering roller during the meandering control operation in the state in which the transfer members are applied.

12 Claims, 7 Drawing Sheets

IMAGE FORMING APPARATUS

BACKGROUND OF THE INVENTION

1. Field of the Invention

The present invention relates to an image forming apparatus configured to form an image on a recording medium by using an electro-photographic system such as a copier, a printer, a facsimile machine, and a multi-function printer.

2. Description of the Related Art

Conventionally, there is known a tandem-type image forming apparatus configured to form an image by using an endless intermediate transfer belt among image forming apparatuses such as a copier, a printer and others. This image forming apparatus is configured to form toner images of yellow, magenta, cyan and black by a plurality of image forming portions each including a photosensitive drum, to primarily transfer the toner images by superimposing on the intermediate transfer belt, to secondarily transfer the toner images to a recording medium (sheet), and to fix the toner images on the recording medium by pressure and heat.

In general, the intermediate transfer belt is stretched around a driving roller configured to apply a driving force to the intermediate transfer belt, a tension roller tensioning the intermediate transfer belt with a certain tension to form a transfer surface on which the toner images are transferred from the image forming portions, and a stretch roller such as a secondary transfer inner roller. A transfer bias is applied to this secondary transfer inner roller such that the toner images on the intermediate transfer belt are secondarily transferred to the recording medium.

By the way, if a delivering direction of the stretch roller is inconsistent with a direction of the intermediate transfer belt delivered by the driving roller when the intermediate transfer belt is rotationally driven, so-called meandering by which the intermediate transfer belt moves gradually in a direction (main scan direction) orthogonal to a rotating direction of the intermediate transfer belt occurs. If such meandering of the intermediate transfer belt occurs, the toner images formed by the plurality of image forming portions shift in the main scan direction, causing color shift of the respective colors.

In order to prevent such meandering of the intermediate transfer belt, Japanese Patent Application Laid-open No. 2000-34031, for example, discloses a meandering control system configured to correct meandering of the intermediate transfer belt by tilting a steering roller supporting the intermediate transfer belt. Japanese Patent Application Laid-open No. 2013-3381, for example, also discloses a meandering control system configured to move an inclined position of the steering roller in response to attachment/detachment of rotors disposed around in contact with the intermediate transfer belt to overcome a problem that the inclined position of the steering roller where travel of the intermediate transfer belt is stabilized is changed by the attachment/detachment of the rotors.

However, a time until when the travel of the intermediate transfer belt is stabilized by the meandering control and the inclined position of the steering roller vary depending on fluctuations of a coefficient of friction between an inner surface of the intermediate transfer belt and a surface of the steering roller. This occurs because traveling speed of the intermediate transfer belt with respect to an inclination of the steering roller varies, and the time until when the travel of the intermediate transfer belt is stabilized also varies. For instance, if the time until when the travel of the intermediate transfer belt is stabilized is prolonged, a state in which the travel of the intermediate transfer belt is unstable occurs before starting to form an image. Color shifts occur in this state because the intermediate transfer belt travels aslant in the main scan direction, making it difficult to output a high quality image.

The move of the inclined position of the steering roller where the travel of the intermediate transfer belt is stabilized occurs also by the application of the transferring high-voltages (primary and secondary transfer biases) for transferring the toner images to the intermediate transfer belt. This problem occurs because a direction of a rotational axis of the photosensitive drum of each color disposed in contact with the intermediate transfer belt is not at right angles to a traveling direction (rotating direction) of the intermediate transfer belt and becomes obvious by an action on absorption power generated by the application of the transferring high-voltage.

In view of the state described above, it is necessary to move the inclined position of the steering roller corresponding to a status of the image forming apparatus in order to quickly stabilize the travel of the intermediate transfer belt. To that end, there arises a problem that the inclined position corresponding to the operation condition of the image forming apparatus must be detected and to update the inclined position at any times.

SUMMARY OF THE INVENTION

According to one aspect of the invention, an image forming apparatus includes an image carrier, a rotatable endless intermediate transfer belt on which a toner image is transferred from the image carrier, a first transfer member configured to transfer the toner image to the intermediate transfer belt while facing to the image carrier with the intermediate transfer belt between the first transfer member and the image carrier; a second transfer member configured to transfer the toner image on the intermediate transfer belt to a recording medium, a stretch roller and a steering roller rotatably supporting the intermediate transfer belt, a tilting unit configured to tilt the steering roller; a first detecting portion configured to detect an inclined position of the steering roller, a second detecting portion configured to detect a position in a width direction orthogonal to a rotating direction of the intermediate transfer belt, a storage portion configured to store a reference inclined position of the steering roller in a state in which transfer biases are applied to both of the first and second transfer members as a reference position, a control portion configured to execute an operation of controlling a tilt of the steering roller based on a detection result of the second detecting portion by operating the tilting unit, the control portion setting an inclined position of the steering roller to the reference position in response to the application of the transfer biases to the first and second transfer members in forming an image, executing the operation from the reference position, and updating the reference position stored in the storage portion based on the inclined position of the steering roller during the operation in the state in which the transfer biases are applied.

According to another aspect of the invention, an image forming apparatus includes an image carrier; a rotatable endless intermediate transfer belt on which a toner image is transferred from the image carrier; a first transfer member configured to transfer the toner image to the intermediate transfer belt while facing to the image carrier with the intermediate transfer belt between the first transfer member and the image carrier; a second transfer member configured to transfer the toner image on the intermediate transfer belt to a recording medium; a stretch roller and a steering roller rotatably supporting the intermediate transfer belt; a tilting portion configured to tilt the steering roller; an inclined position detecting portion configured to detect an inclined position of the steering roller; a belt position detecting portion configured to detect a position in a width direction orthogonal to a rotating direction of the intermediate transfer belt; a storage portion configured to store a reference inclined position of the steering roller in a state in which transfer biases are applied to both of the first and second transfer members as a reference position; a control portion performing a meandering control operation of controlling the widthwise position of the intermediate transfer belt by operating the tilting portion, the control portion tilting the steering roller to the reference position in response to the application of the transfer biases to the first and second transfer members to perform the meandering control operation from this reference position in forming an image, and updating the reference position stored in the storage portion to execute the meandering control operation by using the updated reference position in forming an image in a next time.

Further features of the present invention will become apparent from the following description of exemplary embodiments with reference to the attached drawings.

DESCRIPTION OF THE EMBODIMENTS

First Embodiment

Figure 1:
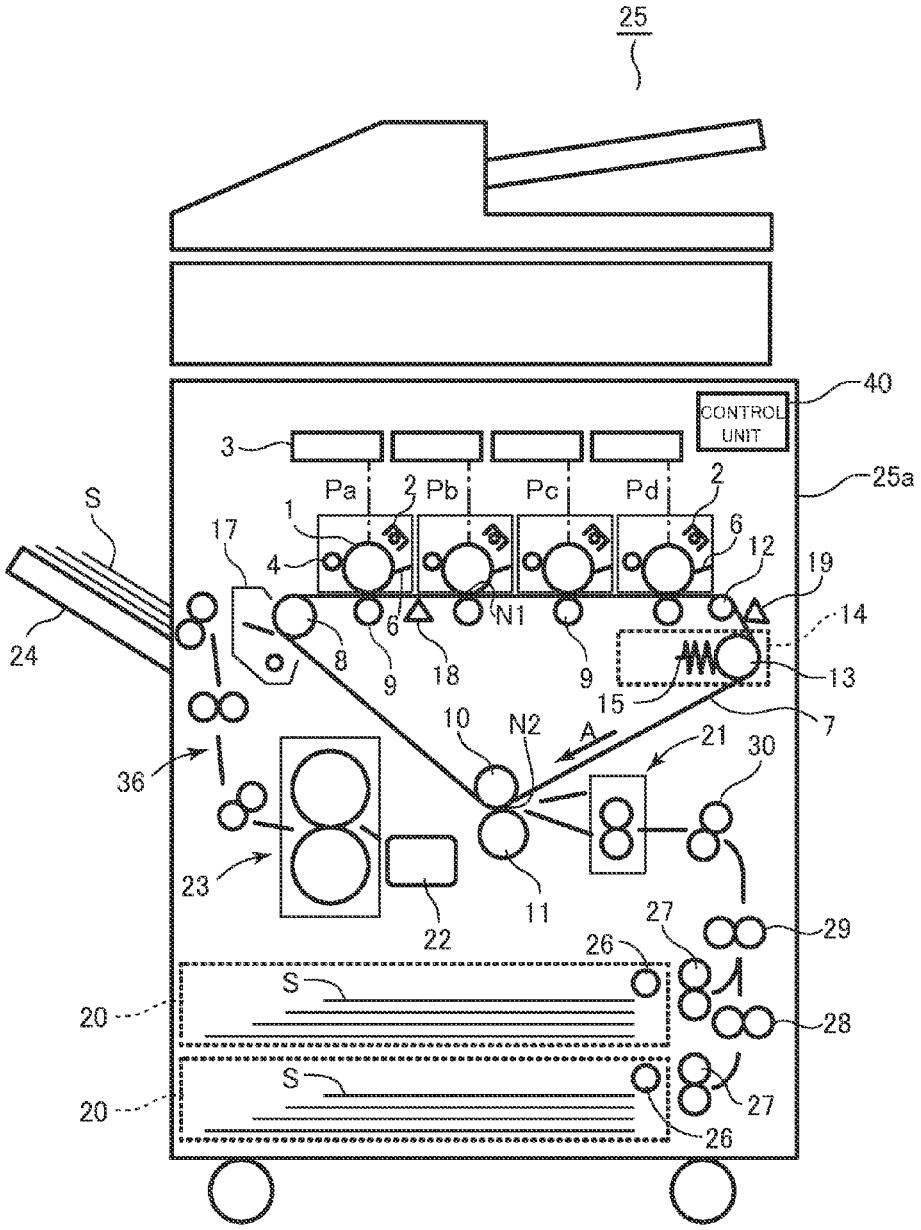
FIG. 1 is a section view schematically illustrating a configuration of an image forming apparatus of an embodiment of the present invention.

A first embodiment of the present invention will be explained in detail with reference to the drawings. Firstly, an image forming apparatus 25 of the embodiment will be explained with reference to FIG. 1. FIG. 1 is a section view schematically showing the image forming apparatus 25. The image forming apparatus 25 is a tandem-type full color laser printer in which image forming portions Pa, Pb, Pc and Pd are disposed along a traveling direction of an endless intermediate transfer belt 7.

[Image Forming Apparatus]

As shown in FIG. 1, the image forming apparatus 25 includes an apparatus body 25*a*, and the image forming portions Pa through Pd are provided in parallel within the apparatus body 25*a* and form toner images of respective different colors through processes of forming latent images, of developing the latent images and of transferring the developed images. The image forming portion Pa of yellow (Y), the image forming portion Pb of magenta (M), the image forming portion Pc of cyan (C), and the image forming portion Pb of black (Bk) are disposed in this order from upstream in the traveling direction of the intermediate transfer belt 7. Each of these image forming portions Pa through Pd includes an electro-photosensitive body (a photosensitive drum 1 in the present embodiment) as a dedicated image carrier. The toner images of the respective colors are formed on the respective photosensitive drums 1.

The intermediate transfer belt 7 is provided to come into contact with the respective photosensitive drums 1 and the respective color toner images formed on the photosensitive drums 1 in the image forming portions Pa through Pd are primarily transferred to the intermediate transfer belt 7 at primary transfer portions (N1) and are secondarily transferred to a recording medium (sheet) S at a secondary transfer portion (N2). Then, the recording medium S on which the toner images have been transferred is conveyed to a fixing unit 23 to be heated and pressed to fix the toner images, and is then discharged out of the apparatus as a recording medium on which the image has been formed.

The intermediate transfer belt 7 is constructed as a rotatable endless member to which the toner images are transferred from the photosensitive drums (image carriers) 1. The primary transfer portion N1 includes a primary transfer member (first transfer member) 9 for transferring the toner images on the photosensitive drum 1 to the intermediate transfer belt 7 while facing to the intermediate transfer belt 7 with the intermediate transfer belt 7 between the primary transfer portion and the photosensitive drum 1. The secondary transfer portion N2 includes a secondary transfer member (second transfer member) 11 for transferring the toner images on the intermediate transfer belt 7 to the recording medium S.

Disposed around each photosensitive drum 1 are a charger 2, a developer 4, a primary transfer roller (first transfer member) 9 and a cleaning blade 6. Laser scanners 3 are provided respectively above the photosensitive drums 1.

A light source unit and a polygonal mirror (not shown) are provided within each laser scanner 3. Each laser scanner 3 is configured to scan a laser beam emitted from the light source unit by rotating the polygonal mirror and to deflect a luminous flux of the scanned light by a reflection mirror. Then, the light is condensed and exposed on a generating line of each photosensitive drum 1 by an f lens (not shown) to form a latent image corresponding to image signals on a surface of each photosensitive drum 1.

Predetermined amounts of toners of yellow (Y), magenta (M), cyan (C) and black (Bk) are filled as developers in the respective developers 4 by supply units (not shown). The developers 4 develop the latent images respectively formed on the photosensitive drums 1 to visualize a yellow toner image, a magenta toner image, a cyan toner image and a black toner image.

The intermediate transfer belt 7 is rotationally driven with same peripheral speed of each photosensitive drum 1 in a direction indicated by an arrow A in FIG. 1. The toner images formed respectively on the photosensitive drums of the image forming portions Pa through Pd are primarily transferred to an outer circumferential surface of the belt by an electric field and pressure formed by the primary transfer bias applied to the intermediate transfer belt 7 through the primary transfer rollers 9 in a process of passing through the respective primary transfer portions N1.

The intermediate transfer belt 7 is rotatably stretched around a driving roller 8, a steering roller 13, a secondary transfer inner roller 10 and a driven roller (stretch roller) 12. The driving roller 8 is connected to a driving portion (not shown). A secondary transfer outer roller 11 is also disposed at a position facing the secondary transfer inner roller 10. The secondary transfer inner roller 10, the driven roller 12, the driving roller 8 and the secondary transfer outer roller (second transfer member) 11 are in contact with the intermediate transfer belt 7 while being borne in parallel with a direction orthogonal to the rotating direction of the intermediate transfer belt 7.

The steering roller 13 is disposed while being linked to a steering position control mechanism 14 to perform meandering control operations on the intermediate transfer belt 7. The steering position control mechanism 14 constitutes a tilting portion configured to tilt the steering roller 13. The steering roller 13 generates a certain tension to the intermediate transfer belt 7 by being biased by a tension spring 15. One end of the steering roller 13 is supported by a fixed bearing (not shown) and another end thereof is supported swingably to a bearing (not shown).

The secondary transfer outer roller 11 disposed so as to face to the secondary transfer inner roller 10 forms a secondary transfer nip portion (the secondary transfer portion) N2 between the intermediate transfer belt 7 by nipping and pressing the intermediate transfer belt 7 between the secondary transfer inner and outer rollers 10 and 11. A desired primary transfer bias is applied to each primary transfer roller 9 by a primary transfer bias source (not shown) and a desired secondary transfer bias is applied to the secondary transfer outer roller 11 by a secondary transfer bias source (not shown).

Here, after when the toner images of the respective colors formed on the photosensitive drums 1 of the image forming portions Pa through Pd are primarily transferred to the intermediate transfer belt 7 at the primary transfer portions N1, the composite color toner image transferred and superimposed on the intermediate transfer belt 7 is secondarily transferred to the recording medium S as follows. It is noted that the photosensitive drum 1 which has finished the primary transferring process undergoes a process of cleaning and removing the transfer residual toner by each cleaning blade 6 to be ready to form a next latent image successively.

That is, while the recording medium S is delivered out of a sheet feeding cassette 20 disposed at an under part of the apparatus body 25*a* through a sheet feeding roller 26, a separating conveying roller 27, conveying rollers 28, 29 and 30, the recording medium S is stopped once at a registration roller 21. Then, the recording medium S is sent to the secondary transfer nip portion N2 through a pre-transfer guide (not shown) with a predetermined timing adjusted to the composite color toner image on the intermediate transfer belt 7. At the same time, the secondary transfer bias is applied from the bias power supply to the secondary transfer nip portion N2 through the secondary transfer outer roller 11 and the composite color toner image is secondarily transferred from the intermediate transfer belt 7 to the recording medium S by this secondary transfer bias. It is noted that after the secondary transfer process, the toner remaining on the intermediate transfer belt 7 and other foreign matter are removed by a cleaning unit 17 that brings a cleaning blade into contact with the surface of the intermediate transfer belt 7.

Then, the recording medium S on which the toner image has been secondarily transferred is guided to the fixing unit 23 through a pre-fixing guide 22 to be heated and pressed to fix the toner image. Then, the recording medium S is discharged out to a discharge tray 24 through a conveying path 36.

[Control System for Controlling Meandering of Intermediate Transfer Belt]

Figure 2:
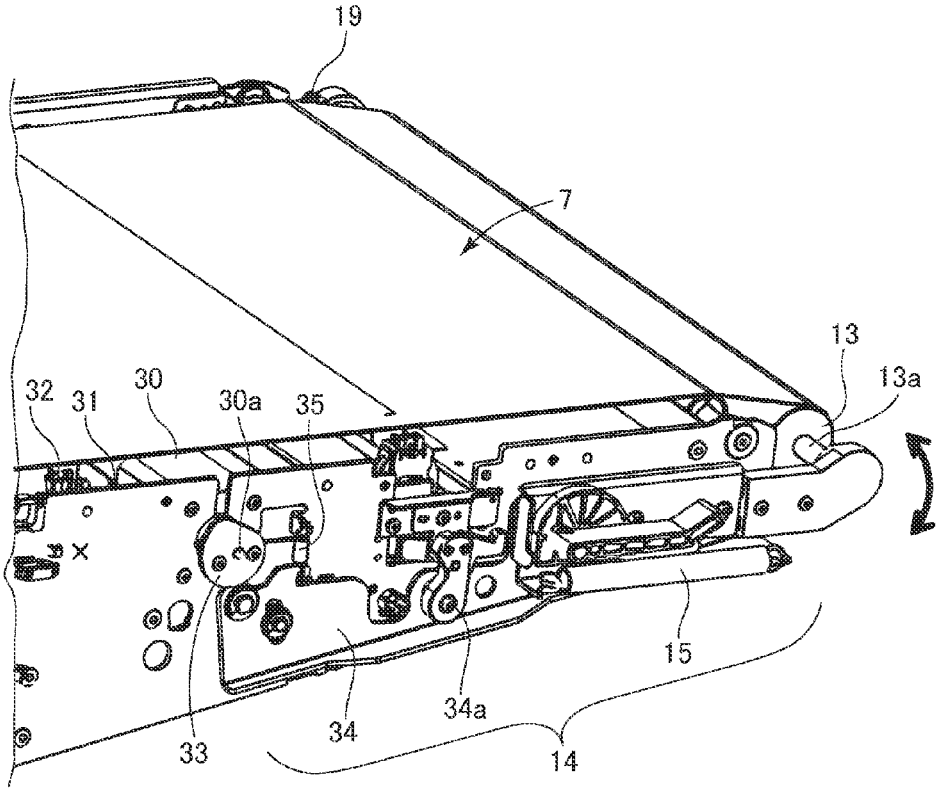
FIG. 2 is a perspective view illustrating a steering position control mechanism of an intermediate transfer belt of the embodiment of the present invention.
Figure 3:
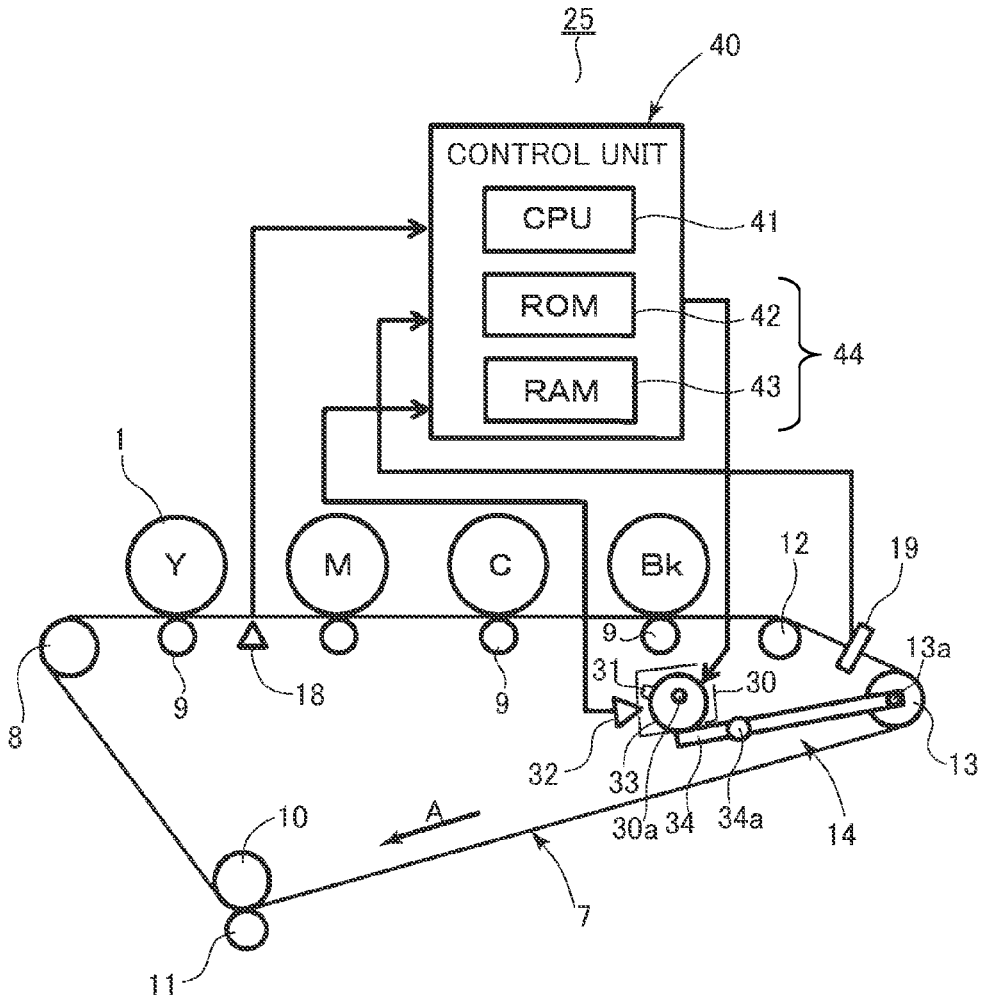
FIG. 3 is a block diagram illustrating a control system configured to control meandering of the intermediate transfer belt of the embodiment.

While meandering control of the intermediate transfer belt 7 of the present embodiment is carried out by using the steering position control mechanism 14 shown in FIGS. 2 and 3, a control unit 40 executes the meandering control operation while monitoring outputs of an edge sensor 19. It is noted that FIG. 2 is a perspective view illustrating the steering position control mechanism 14 of the intermediate transfer belt of the present embodiment and FIG. 3 is a block diagram illustrating a control system for controlling meandering of the intermediate transfer belt.

As shown in FIG. 3, the control unit 40 provided within the apparatus body 25*a* of the image forming apparatus 25 includes a CPU 41, i.e., a control portion, a ROM 42, and a RAM 43, i.e., a storage portion. The apparatus body 25*a* also includes a home position sensor 18 disposed to face to an inner circumferential surface of the intermediate transfer belt 7 and the edge sensor 19 disposed to face to the outer circumferential surface of the intermediate transfer belt 7. The edge sensor 19 constitutes a belt position detecting portion configured to detect a widthwise position orthogonal to the rotating direction of the intermediate transfer belt 7.

The CPU 41, i.e., the control portion, is a control circuit configured to control the whole image forming apparatus. The ROM 42 stores a control program for executing the meandering control. The RAM 43 is a system work memory in which the CPU 41 is operative. In the present embodiment, the ROM 42 and the RAM 43 constitute the storage portion 44. Each detection signal from the home position sensor 18 and the edge sensor 19 is transmitted to the CPU 41 and is converted into a digital signal to be arithmetically processed.

The steering position control mechanism 14, i.e., the tilting portion, includes a steering motor 30, a home position flag 31, a home position detecting sensor 32, a steering cam 33 and a steering arm 34. The CPU 41 controls pulse-wise positions of the steering motor 30 based on each detection signal from the home position sensor 18 and the edge sensor 19 and based on a position where the home position detecting sensor 32 detects the home position flag 31. The CPU 41 also rotates the steering cam 33 to control an inclination angle of the steering roller 13. The home position detecting sensor 32 constitutes an inclined position detecting portion (first detecting portion) configured to detect an inclined position of the steering roller 13 and a cam position detecting portion configured to detect a turning position of the steering cam 33.

The home position sensor 18 is configured to detect a reference mark (not shown) provided on a back surface of the intermediate transfer belt 7 between the image forming portion Pa and the image forming portion Pb shown in FIG. 1 and outputs a signal concerning a reference position in the belt traveling direction. The edge sensor 19 is configured to detect a position of an edge flag (not shown) disposed in contact with an edge of the intermediate transfer belt 7 and outputs an edge position of the intermediate transfer belt 7 continuously as an edge profile.

The edge flag is turnably biased by a spring such that the edge flag is always in contact with the edge of the intermediate transfer belt 7 and outputs the edge position of the intermediate transfer belt 7 by a displacement sensor (not shown) by using a light reflecting surface provided on another edge thereof. It is noted that while the displacement sensor is used in the edge sensor 19 in the present embodiment, an optical area sensor directly measuring the edge position of the intermediate transfer belt 7 may be used. Thus, the present invention does not specifically limit a sensing method.

The CPU 41 stores a reference edge profile of the intermediate transfer belt 7 detected by the edge sensor 19 in an edge detecting mode detailed later in the RAM 43 and generates pulse signals of the steering motor 30 such that the edge sensor 19 outputs signals following the reference edge profile. The CPU 41 controls the steering motor 30 such that the output from the edge sensor 19 falls within a predetermined range, e.g., Δ28 mV in an edge sensor whose sensor characteristic is 1.4 V/mm and judges that the travel of the intermediate transfer belt 7 is stabilized at a moment when the output falls within the predetermined range. The CPU 41 calculates a correction value from an average steering cam position at this time and stores the correction value in the RAM 43, i.e., the storage portion. Then, the CPU 41 cites the correction value stored in the RAM 43 appropriately to calculate a control value and to control the pulse position of the steering motor 30. Control timing is made based on other control signals of the image forming apparatus 25.

The RAM 43 stores the inclined position of the steering roller 13 at a stabilizing position of the intermediate transfer belt 7 as a first inclined position. The first inclined position is the inclined position in the stabilizing position in which the detection result of the edge sensor 19 falls within a predetermined range when the intermediate transfer belt 7 is rotated in a state in which no transfer bias is applied in advance at least to one of the primary and secondary transfer portions N1 and N2. The RAM 43 also stores an inclined position of the steering roller 13 at the stabilizing position in which the detection result of the edge sensor 19 falls within the predetermined range when the intermediate transfer belt 7 is rotated in a state in which the transfer biases are applied to both of the primary and secondary transfer portions N1 and N2 in advance as a second inclined position.

The CPU 41 inclines one end of the steering roller 13 while monitoring the output of the edge sensor 19 to adjust to a position in which the output of the edge sensor 19 is not inclined in a cycle of the intermediate transfer belt 7. This adjustment is made by using the steering position control mechanism 14 shown in FIGS. 2 and 3.

The steering arm 34 constitutes a swing member disposed swingably while being connected to a shaft 13*a* of the steering roller 13. The steering cam 33 constitutes a cam member configured to swing the steering arm (swing member) 34. The steering motor 30 constitutes a cam driving portion turning the steering cam (cam member) 33. This arrangement makes it possible for the CPU (control portion) 41 to precisely execute the meandering control operation by changing a turning position of the steering cam 33 in the present embodiment.

The CPU 41 executes the meandering control operation, i.e., the control of the widthwise position of the intermediate transfer belt 7, by operating the steering position control mechanism (the tilting portion) 14. To that end, the CPU 41 controls the steering position control mechanism 14 such that the detection results of the edge sensor (belt position detecting portion/second detecting portion) 19 fall within the predetermined range. The CPU 41 starts the meandering control operation by inclining the steering roller 13 to a position B (first inclined position) described later based on information of the RAM 43 in forming an image. Then, the CPU 41 continues the meandering control operation by inclining the steering roller 13 to a position C (second inclined position) in applying the transfer bias to both of the primary and secondary transfer portions N1 and N2. The CPU 41 also sets an average of the inclined positions of the steering roller 13 in a case where the intermediate transfer belt 7 is rotated by a certain distance or more while continuing the meandering control operation as a position D (third inclined position) of the steering roller 13 and updates the position C to the position D at a predetermined timing.

The steering motor 30 inclines the steering roller 13 by rotationally driving by itself. The home position flag 31 is attached to a steering motor shaft 30*a* and indicates a home position of the steering roller 13. The home position detecting sensor 32 is configured to detect the home position flag 31 to detect the home position of the steering roller 13. The steering cam 33 is fixed to a tip portion of the steering motor shaft 30*a*. The steering arm 34 is supported by a support bearing 34*a* so as to swing corresponding to a turn of the steering cam 33.

The steering arm 34 is biased clockwise as shown in FIGS. 2 and 3 at a fulcrum of the support bearing 34*a* by a steering spring 35, i.e., a tension spring, such that the steering arm 34 always comes into contact with the steering cam 33. A stepping motor is used for the steering motor 30 to accurately control positions of the steering cam 33. This configuration makes it possible for the CPU 41 to control the inclination in an axial direction of the steering roller 13 (inclination control) and to control meandering by controlling the positions of the steering cam 33 through the intermediary of the steering position control mechanism 14. Still further, because the stepping motor is used for the steering motor 30, i.e., the cam driving portion, it is possible to execute the meandering control operation precisely corresponding to the number of pulses.

Figure 4:
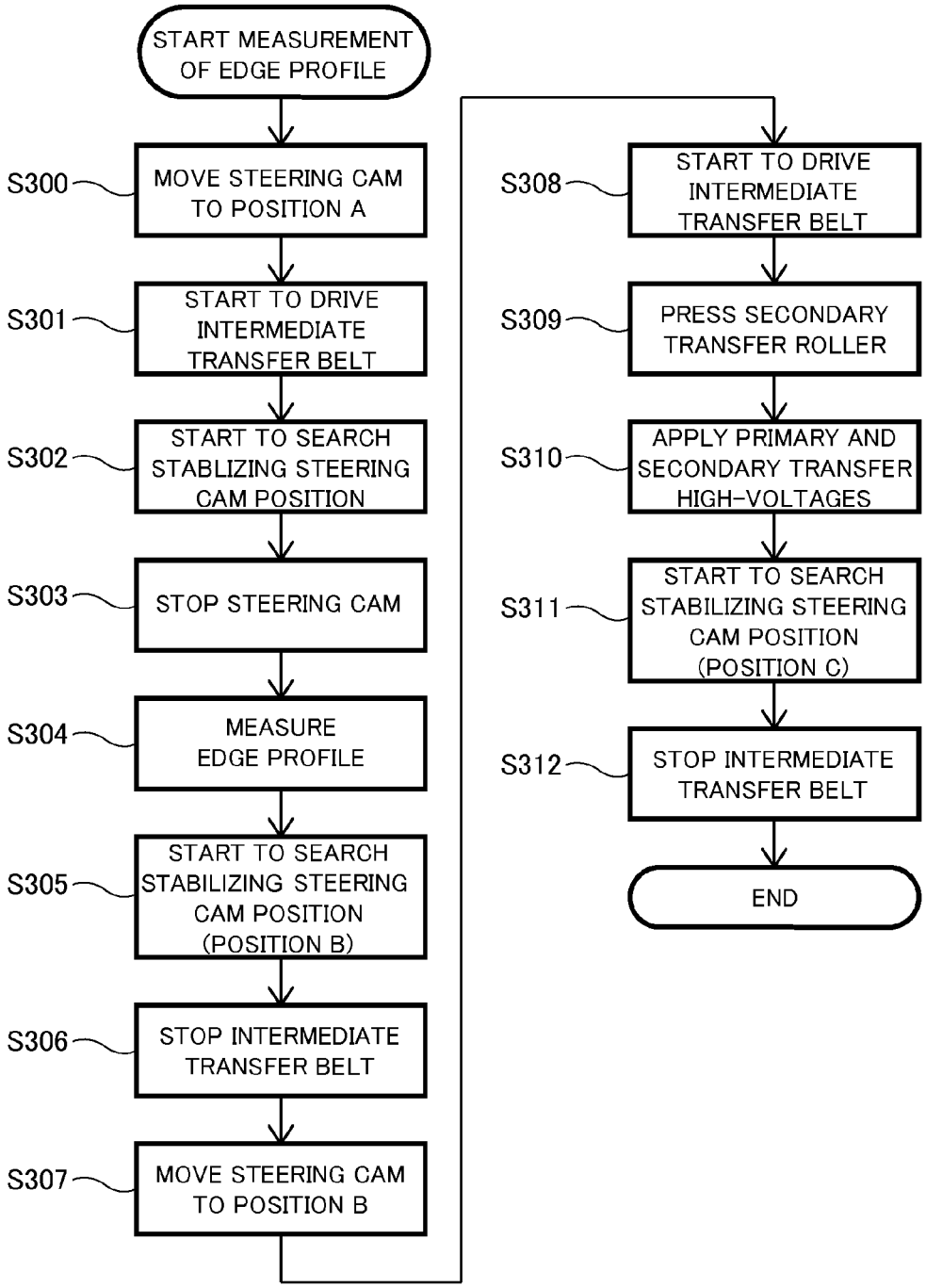
FIG. 4 is a flowchart illustrating steps for searching a steering cam position where travel of the intermediate transfer belt of the embodiment is stabilized.

Feed forward control is made in the inclination control operation such that the output of the edge sensor 19 is equalized with the reference edge profile stored in advance in the RAM 43. Measurement of the edge profile for feed forward control is carried out as shown in FIGS. 4 and 5.

[Measurement of Edge Profile]

The measurement of the edge profile will be explained below with reference to FIGS. 4 and 5. It is noted that FIG. 4 is a flowchart showing steps for searching the position of the steering cam where the travel of the intermediate transfer belt 7 is stabilized in the present embodiment, and FIG. 5 is a graph indicating an edge profile of the intermediate transfer belt 7 in the present embodiment.

Figure 5:
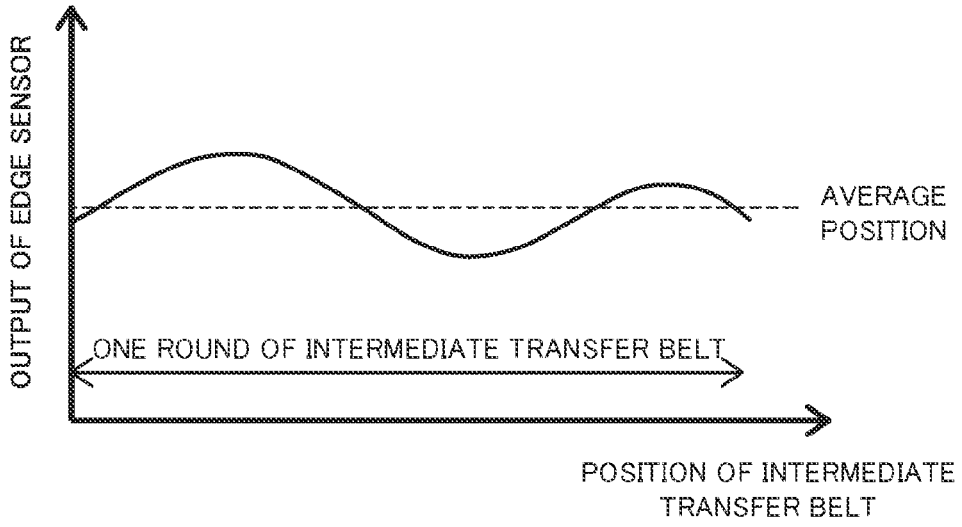
FIG. 5 is a graph showing a shape of an edge of the intermediate transfer belt of the embodiment.

That is, an axis of ordinate in FIG. 5 indicates the output of the edge sensor 19 and an axis of abscissa indicates the position of the intermediate transfer belt 7. At first, the CPU 41 moves the position of the steering cam 33 to an initially set rotational position (position A) based on the home position flag 31 in Step S300. An inclination angle of the steering roller 13 at this time is 0°.

Then, the CPU 41 starts to rotationally drive the intermediate transfer belt 7 in Step S301, monitors the edge sensor 19 and starts to search the stabilizing steering cam position of the steering cam 33 where the output is not inclined in average in Step S302. If the CPU 41 judges that the output of the edge sensor 19 is stabilized, the CPU 41 fixedly excites the steering motor 30 composed of the stepping motor to fix the position of the steering cam 33 once in Step S303.

Then, the CPU 41 rotates the intermediate transfer belt 7 by several turns in the state in which the inclined position of the steering roller 13 is fixed to measure the edge profile on the basis of the home position in Step S304. The CPU 41 further averages the measured edge profiles of the several turns and stores it as the reference edge profile (FIG. 5) in the RAM 43, i.e., the storage portion.

After that, the CPU 41 executes the meandering control operation based on the reference edge profile stored in the RAM 43 and searches again the position of the steering cam 33 where the output of the edge sensor 19 is stabilized in Step S305. The rotational position of the steering cam 33 sought here is stored in the RAM 43 as the position B.

The CPU 41 calculates the position B from a difference from the number of pulses of the steering motor 30 determined at the position A. After calculating the position B, the CPU 41 stops the rotation of the intermediate transfer belt 7 in Step S306. Because this edge profile is characteristic of the individual intermediate transfer belt, the edge profile may be obtained only when the apparatus body 25*a* is installed or the intermediate transfer belt 7 is replaced.

[Inclined Position of Steering Roller]

The CPU 41 successively detects the inclined position of the steering roller 13 corresponding to an operation state and stores in the RAM 43 as follows.

That is, the CPU 41 operates the steering cam 33 by driving the steering motor 30 again based on the edge profile stored in the RAM 43 in Step S307 and executes the meandering control operation by starting to rotationally drive the intermediate transfer belt 7 in Step S308. The CPU 41 starts the meandering control operation from the position B of the steering cam 33.

After that, the CPU 41 presses and brings the secondary transfer outer roller 11 which has been separated from the secondary transfer outer roller 10 into contact with the secondary transfer inner roller 10 in Step S309 to search a position of the steering cam 33 corresponding to the operation state of the image forming apparatus 25. Then, the CPU 41 applies the transfer high-voltages (primary and secondary transfer biases) respectively to the primary transfer portion N1 and the secondary transfer portion N2 in Step S310.

The CPU 41 searches again the position of the steering cam 33 where the output of the edge sensor 19 is stabilized in this state and stores a sought rotational position of the steering cam 33 in the RAM 43 as a position C in Step S311. The CPU 41 calculates the position C from a difference from the number of pulses of the steering motor 30 determined at the position B. After calculating the position C, the CPU 41 stops the intermediate transfer belt 7 in Step S312.

While an edge detecting mode of detecting the edge profile and the positions B and C of the steering cam 33 is provided exclusively in the present embodiment described above, this edge detecting mode is executed when the apparatus body 25*a* is installed or when the intermediate transfer belt 7 is replaced.

In the present embodiment, the edge sensor 19, i.e., belt position detecting portion/second detecting portion, detects the widthwise position of the edge of the intermediate transfer belt 7. Then, the CPU 41, i.e., the control portion, is configured to be able to execute the edge detecting mode, i.e., a measuring mode, of measuring the positions B and C (first and second inclined positions). During the execution of the edge detecting mode, the CPU 41 executes the meandering control operation after moving the steering roller 13 to the position B (the first inclined position) and measures the position of the widthwise edge of the intermediate transfer belt 7 at this time for at least one round of the intermediate transfer belt 7. Then, the CPU 41 performs the meandering control operation in forming an image by using the result (edge profile, edge shape) measured in this edge detecting mode. This configuration makes it possible to execute the meandering control operation accurately by using the edge profile.

[Operational Steps in Forming Color Image]

Figure 6:
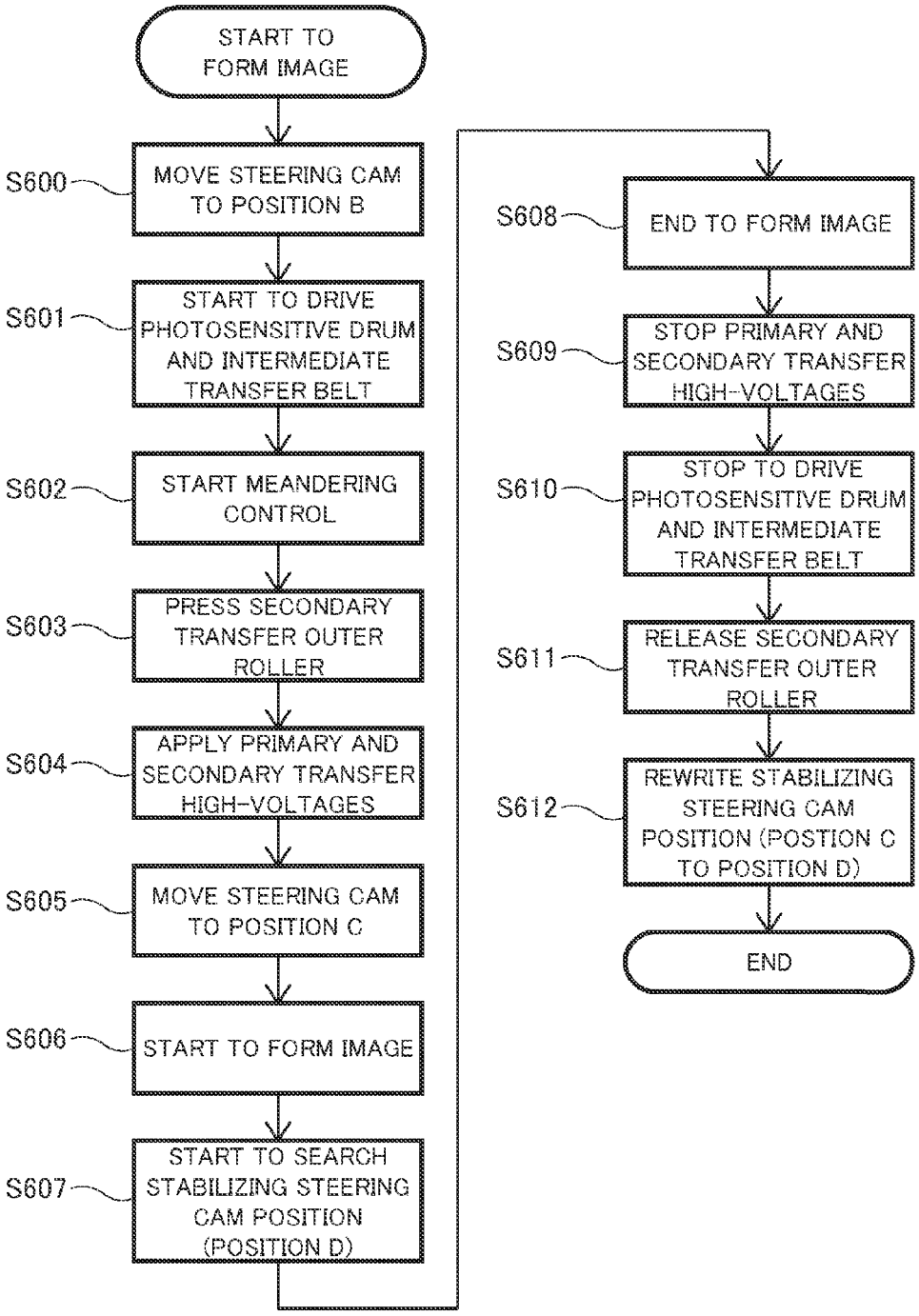
FIG. 6 is a flowchart showing operational steps in forming a color image in the present embodiment.

Next, operational steps in forming a color image by the image forming apparatus 25 constructed as described above will be explained with reference to FIG. 6. It is noted that FIG. 6 is a flowchart showing the operational steps in forming a color image in the present embodiment.

That is, the secondary transfer outer roller 11 is separated from the intermediate transfer belt 7 as described above during when the image forming apparatus 25 is in a standby state. If the operation of forming an image is started in this state, the CPU 41 drives the steering motor 30 to move the steering cam 33 to the position B in Step S600. Along with that, the CPU 41 starts to rotationally drive the photosensitive drum 1 and the intermediate transfer belt 7, respectively, in Step S601.

The CPU 41 detects the home position of the intermediate transfer belt 7 through the home position detecting sensor 32 and starts the meandering control operation of the intermediate transfer belt 7 in Step S602. At this time, the meandering control operation is started when the steering cam 33 is located at the position B described above.

After starting the meandering control, the CPU 41 presses the secondary transfer outer roller 11 to be in contact with the secondary transfer inner roller 10 in Step S603. Then, the CPU 41 applies the transfer high-voltages (the primary and secondary transfer biases) to the primary transfer portion N1 and the secondary transfer portion N2, respectively, in Step S604 to complete preparations for forming the image by the image forming portions Pa through Pd. The CPU 41 also moves the position of the steering cam 33 to the position C at this timing.

Successively, the CPU 41 executes the formation of images in order of yellow (Y), magenta (M), cyan (C) and black (Bk) in Step S606 and sequentially transfers the toner images on the intermediate transfer belt 7 through the primary transfer portion N1. After that, the CPU 41 conveys the toner images on the intermediate transfer belt 7 to the secondary transfer portion N2 to secondarily transfer to the recording medium S.

Then, the CPU 41 conveys the recording medium S to the fixing unit 23 and discharges on the discharge tray 24. At this time, the CPU 41 measures the position of the steering cam 33 as necessary also during the formation of the image and calculates the average steering cam (stabilizing steering cam) position in the same manner with that in executing the edge detecting mode (start to search the position) in Step S607.

If the position of the average steering cam (stabilizing steering cam) until finishing the formation of the image is denoted as a position D, it is possible to change the position of the steering cam 33 moving in starting a next operation from the position C to the position D by monitoring a difference between the positions C and D.

Then, the CPU 41 ends to form an image in Step S608, stops to apply the transfer high-voltages (the primary and secondary transfer biases) in Step S609, and stops to drive each photosensitive drum 1 and the intermediate transfer belt 7 in Step S610. Still further, the CPU 41 separates the secondary transfer outer roller 11 from the secondary transfer inner roller 10 to release the contact with the intermediate transfer belt 7 in Step S611 and stops the operation of the image forming apparatus 25.

Here, the CPU 41 changes (rewrites) the average steering cam position stored in the RAM 43 from the position C to the position D in Step S612. The abovementioned predetermined timing of thus updating information of the position C (second inclined position) to that of the position D (third inclined position) is set per every period from an end of a preceding image forming operation to a start of a succeeding image forming operation. This arrangement makes it possible to update the position from the position C to the position D every time when a preceding image forming operation ends, so that it is possible to start the meandering control operation from an optimum position of the steering cam 33.

Here, while it has been described such that the average steering cam (stabilizing steering cam) position is measured until the image forming steps end, it may be an average of several rounds of the intermediate transfer belt just before ending the image forming steps. It is noted that the timing for rewriting the position from the position C to the position D may not be always in a period until ending the image forming steps, and it is possible to arrange such that the position is rewritten in starting by turning on a main power source of the apparatus body 25*a* again to start image forming steps after once turning off the power supply.

As described above, the storage portion 44 stores the reference inclined position of the steering roller 13 in the state in which the transfer biases are applied to both of the primary and secondary transfer members (first and second transfer members) 9 and 11 as the bias-applied reference inclined position, i.e., reference position, in the present embodiment. Then, the CPU (control portion) 41 is configured to tilt the steering roller 13 to the bias-applied reference inclined position and to perform the meandering control from this bias-applied reference inclined position when the transfer biases are applied to the primary and secondary transfer portions N1 and N2 in forming an image. The CPU 41 is also configured to be able to update the bias-applied reference inclined position stored in the storage portion 44 based on the inclined position of the steering roller 13 during the meandering control in the state in which the transfer biases are applied. For instance, in the embodiment described above, the storage portion 44 stores the position C as an initial value of the bias-applied reference inclined position, and the CPU 41 updates the bias-applied reference inclined position stored in the storage portion 44 from the position C to the position D based on a result of the meandering control in forming the image.

In other words, the CPU 41 is configured to execute an operation of controlling a tilt of the steering roller 13 based on a detection result of the edge sensor (second detecting portion) 19 by operating the tilting unit. The CPU 41 sets an inclined position of the steering roller 13 to the reference position in response to the application of the transfer biases to the first and second transfer members 9 and 11 in forming an image, executes the operation from the reference position, and updates the reference position stored in the storage portion 44 based on the inclined position of the steering roller 13 during the operation in the state in which the transfer biases are applied.

Because the bias-applied reference inclined position stored in the storage portion 44 is thus updated, it is possible to execute the meandering control by using the updated bias-applied reference inclined position after forming an image in a next time. That is, because the position D is updated at any time and every time when the apparatus body 25*a* is operated, the meandering control can be started appropriately from the optimum position of the steering cam 33 even if installation environments (humidity and temperature) change or conditions of the apparatus change due to repetitive image forming operations. Accordingly, it is possible to shorten the time until when the travel of the intermediate transfer belt 7 is stabilized.

In addition to that, the storage portion 44 stores a reference inclined position of the steering roller 13 (the position B described above for example) in the state in which no transfer bias is applied at least to one of the primary and secondary transfer portions N1 and N2 as a preparatory inclined position, i.e., preparatory position. Then, the CPU 41 starts the meandering control by setting the inclined position of the steering roller 13 to the preparatory inclined position before when the transfer biases are applied to the primary and secondary transfer portions N1 and N2 in forming the image, and continues the meandering control by changing the inclined position of the steering roller 13 to the bias-applied reference inclined position based on the application of the transfer biases to the primary and secondary transfer portions N1 and N2. This arrangement makes it possible to further shorten the time until when the travel of the intermediate transfer belt 7 is stabilized.

Still further, in the present embodiment, the CPU 41 is configured to be able to execute the edge detecting mode described above as the measuring mode for updating the initial values of the bias-applied reference inclined position and the preparatory inclined position. That is, in the measuring mode, the CPU 41 rotates the intermediate transfer belt 7 in the state in which no transfer bias is applied at least to one of the primary and secondary transfer portions N1 and N2 to search an inclined position of the steering roller 13 at the stabilizing position where the detection result of the edge sensor (belt position detecting portion) 19 falls within the predetermined range. In the same manner, the CPU 41 searches an inclined position of the steering roller 13 at the stabilizing position of the intermediate transfer belt 7 in the state in which the transfer biases are applied to the primary and secondary transfer portions N1 and N2. Then, the CPU 41 stores the sought inclined position of the steering roller 13 at the stabilizing position as initial values of the preparatory inclined position and the bias-applied reference inclined position, respectively. Because this measuring mode is executed after replacing the intermediate transfer belt 7, the preparatory inclined position and the bias-applied reference inclined position can be set adequately in accordance to a new intermediate transfer belt 7.

Still further, because the distance more than the certain distance described above is set to be a distance more than one round of the intermediate transfer belt 7 in the present embodiment, it is possible to avoid a calculation accuracy of the average steering cam position from being lowered. That is, the calculation accuracy of the average steering cam position is possibly lowered if a time during which the transfer high voltages (primary and secondary transfer biases) are applied is shorter than a time required for the intermediate transfer belt 7 to travel by one round of distance, so that the update from the position C to the position D is not carried out in such a case. Thus, the CPU 41 does not update the information of the position C (the second inclined position) if the time during which the transfer biases are applied to the primary and secondary transfer portions N1 and N2 is shorter than the time required for the intermediate transfer belt 7 to rotate by one round or more. This arrangement makes it possible to prevent the calculation accuracy of the average steering cam position from being lowered.

The abovementioned control makes it possible to quickly stabilize the travel of the intermediate transfer belt 7 before starting to form an image and to output a high quality image having less color shift. That is, the present embodiment makes it possible to detect and store the inclined position of the steering roller 13 corresponding to the operating condition of the image forming apparatus 25 and to update the stored inclined position of the steering roller 13 at any time. Still further, it is possible to shorten the time until when the travel of the intermediate transfer belt 7 is stabilized by moving the inclined position based on this updated result.

Still further, because the present embodiment can deal with aging of the intermediate transfer belt 7 caused by repetitive image forming operations (durability), it is possible to permanently stabilize the time until when the travel of the intermediate transfer belt 7 is stabilized. Thereby, it is possible to stably output a high quality image in which color shift is suppressed in the image forming apparatus 25 forming a color image by using the intermediate transfer belt 7.

Modified Example

Figure 7:
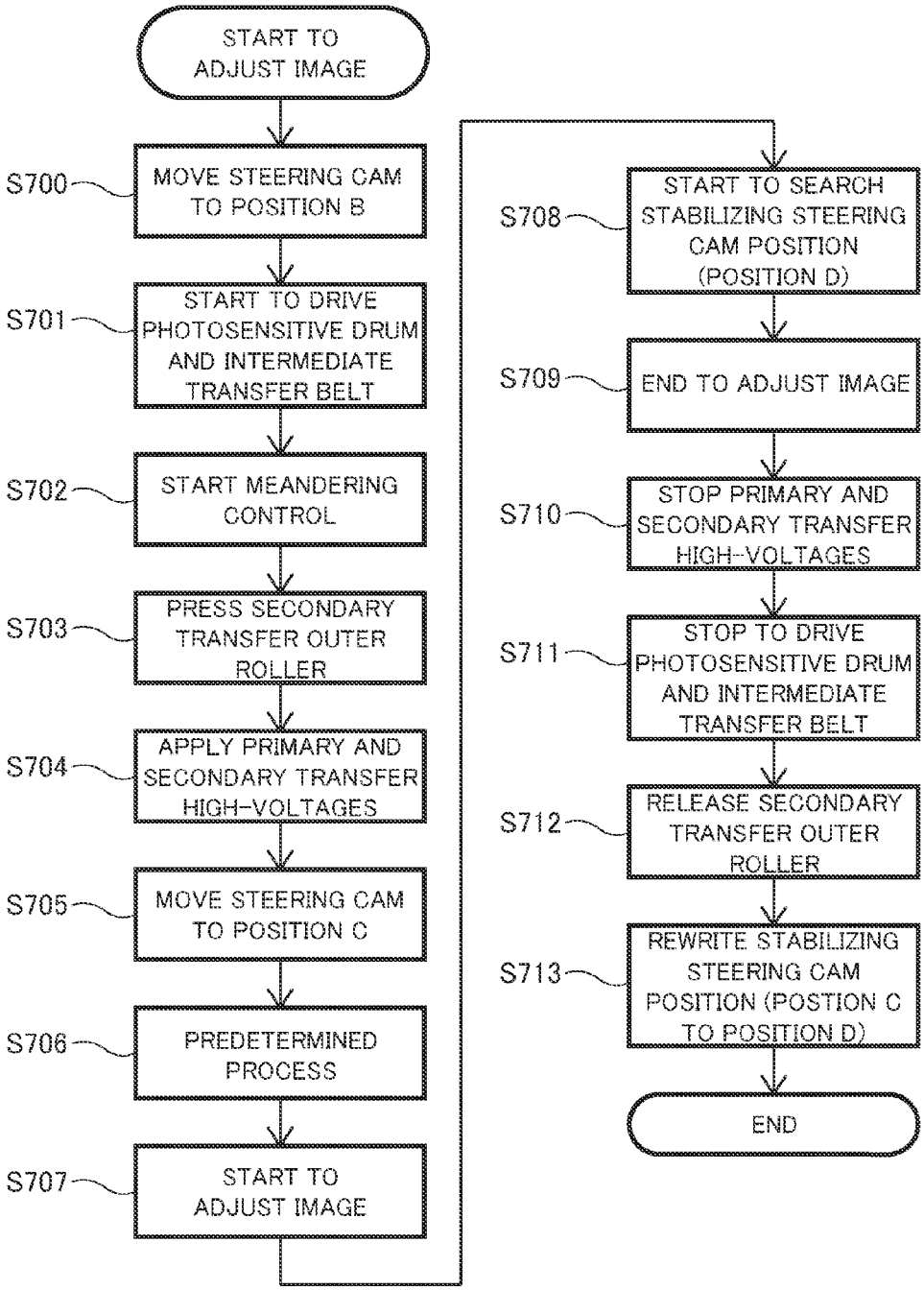
FIG. 7 is a flowchart showing an image adjusting sequence in a modified example.

Next, a modified example of the embodiment described above will be explained with reference to FIG. 7. It is noted that in the modified example, because the main schematic configuration of the invention is the same with the embodiment described above, their explanation will be omitted here. It is noted that FIG. 7 is a flowchart showing an image adjusting sequence of the modified example.

In the modified example, an example in which a process of detecting an average steering cam (stabilizing steering cam) position (position D) different from that of the embodiment described above is applied will be explained. That is, while the position D is calculated based on the average steering cam position while forming an image in the embodiment described above, if an image forming time is short, for example, a traveling time of the intermediate transfer belt 7 is also short, lowering the calculation accuracy of the average steering cam position. In such a case, there is a case where it is better to start the meandering control not from the position D but from the position C. If a state in which a number of output sheets is small and the image forming time is short continues, there is a possibility that the meandering control cannot be started from an optimum position.

In order to avoid such a circumstance, the position D is not calculated while forming an image in the modified example. For instance, an average steering cam position is monitored during an image adjusting sequence such as correction of color shift executed in turning power on and the average steering cam position is set as the position D.

That is, when the image forming apparatus 25 is in the standby state, the secondary transfer outer roller 11 is separated from the intermediate transfer belt 7. If the image adjusting sequence is started at first in this state, the CPU 41 drives the steering motor 30 to move the steering cam 33 to the position B in Step S700. Along with that, the CPU 41 starts to rotationally drive the photosensitive drum 1 and the intermediate transfer belt 7, respectively, in Step S701.

The CPU 41 detects the home position of the intermediate transfer belt 7 through the home position detecting sensor 32 and starts the meandering control operation of the intermediate transfer belt 7 in Step S702. At this time, the meandering control operation is started when the steering cam 33 is located at the position B described above.

After starting the meandering control operation, the CPU 41 presses the secondary transfer outer roller 11 to be in contact with the secondary transfer inner roller 10 in Step S703. Then, the CPU 41 applies the transfer high-voltages to the primary and secondary transfer portions N1 and N2 in Step S704 to complete preparations for forming the image by the image forming portions Pa through Pd. The CPU 41 also moves the position of the steering cam 33 to the position C at this timing in Step S705.

Then, the CPU 41 executes a predetermined process set in advance in Step S706. As this predetermined process, a process of detecting the home position of the intermediate transfer belt 7 by using the home position sensor 18 can be carried out, for example. That is, a difference of the home position is started to be measured from here.

Successively, the CPU 41 executes the image adjusting process such as the correction of color shift in Step S707. In this image adjusting process, the CPU 41 forms correcting patches in order of yellow (Y), magenta (M), cyan (C) and black (Bk) and sequentially transfers to the intermediate transfer belt 7 through the primary transfer portion N1. Then, the CPU 41 executes the process such as the correction of color shift by judging signals detected by a sensor (not shown) detecting the correction patches. Then, the CPU 41 measures the position of the steering cam 33 while adjusting the image at any time from the home position and calculates the average steering cam position in the same manner in executing the edge detecting mode (start to search) in Step S708.

If the average steering cam position until finishing the image forming (image adjusting) operation is supposed to be a position D, it is possible to change the position of the steering cam 33 to be moved in starting a next operation from the position C to the position D by monitoring a difference between the positions C and D.

Then, the CPU 41 ends the image adjusting operation in Step S709, stops to apply the transfer high-voltages (the primary and secondary transfer biases) in Step S710, and stops to drive each photosensitive drum 1 and the intermediate transfer belt 7 in Step S711. Still further, the CPU 41 separates the secondary transfer outer roller 11 from the secondary transfer inner roller 10 to release the contact with the intermediate transfer belt 7 in Step S712 and stops the operation of the image forming apparatus 25.

Here, the CPU 41 changes (rewrites) the average steering cam position stored in the RAM 43 from the position C to the position D in Step S713.

Because the image adjusting sequence is executed always in a stable time, the traveling distance of the intermediate transfer belt 7 can be also determined in advance. Accordingly, it is possible to calculate the average steering cam position with the same timing. For instance, if a time during which the transfer high voltage is applied continuously in the image adjusting sequence is three rounds or more of the intermediate transfer belt 7, it is possible to calculate the average steering cam position of the three rounds.

Still further, if the image adjusting sequence is executed based on the home position of the intermediate transfer belt 7, it is possible to monitor the position of the steering cam 33 always from the same position and the time of the image adjusting sequence is not prolonged by a reason of the measurement of the position D. It is noted that while the image adjusting sequence has been exemplified here, any sequence may be adopted as long as a time during which the transfer high voltage is applied is that of one round or more of the intermediate transfer belt 7.

As described above, the time of adjusting mode of transferring an adjusting toner image to the intermediate transfer belt 7 is included to adjust the image forming apparatus 25 in the image forming operation described above in this modified example. Due to that, even if the image forming time is short and the traveling time of the intermediate transfer belt 7 is short, the position D is not calculated during the formation of the image but the position D may be set by the average steering cam position monitored during the image adjusting process such as the correction of color shift executed in turning power on. Due to that, even if the image forming time is short, it is possible to execute the meandering control from the optimum position. Accordingly, the modified example makes it possible to quickly stabilize the travel of the intermediate transfer belt 7 before starting to form an image and to output a high quality image having extremely less color shift.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment (s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-009545, filed on Jan. 22, 2014, which is hereby incorporated by reference herein in its entirety.

What is claimed is:

1. An image forming apparatus comprising:

an image carrier;

a rotatable endless intermediate transfer belt on which a toner image is transferred from the image carrier;

a first transfer member configured to transfer the toner image to the intermediate transfer belt while facing the image carrier with the intermediate transfer belt between the first transfer member and the image carrier;

a second transfer member configured to transfer the toner image on the intermediate transfer belt to a recording medium;

a stretch roller and a steering roller rotatably supporting the intermediate transfer belt;

a tilting unit configured to tilt the steering roller;

a first detecting portion configured to detect an inclined position of the steering roller;

a second detecting portion configured to detect a position in a width direction orthogonal to a rotating direction of the intermediate transfer belt;

a storage portion configured to store a reference inclined position of the steering roller in a state in which transfer biases are applied to both of the first and second transfer members as a reference position;

a control portion configured to execute an operation of controlling a tilt of the steering roller based on a detection result of the second detecting portion by operating the tilting unit, the control portion setting an inclined position of the steering roller to the reference position in response to the application of the transfer biases to the first and second transfer members in forming an image, executing the operation from the reference position, and updating the reference position stored in the storage portion based on the inclined position of the steering roller during the operation in the state in which the transfer biases are applied.

2. The image forming apparatus according to claim 1, wherein the storage portion stores a reference inclined position of the steering roller in a state in which no transfer bias is applied at least to one of the first and second transfer members as a preparatory position, and wherein the control portion starts the operation by setting the inclined position of the steering roller to the preparatory position before the transfer biases are applied to the first and second transfer members in forming the image and continues the control operation by changing the inclined position of the steering roller to the reference position in response to the application of the transfer biases to the first and second transfer members.

3. The image forming apparatus according to claim 2, wherein the control portion executes a measuring mode of executing operations of:

rotating the intermediate transfer belt in a state in which the transfer bias is not applied at least to one of the first and second transfer members, searching an inclined position of the steering roller in a stabilizing position of the intermediate transfer belt in which a detection result of the belt position detecting portion falls within a predetermined range, storing the inclined position of the steering roller at the stabilizing position in the storage portion as the preparatory position, searching an inclined position of the steering roller at a stabilizing position in which a detection result of the belt position detecting portion falls within a predetermined range by applying the transfer biases to the first and second transfer members from the state in which the inclined position of the steering roller is located at the preparatory position, and storing the inclined position of the steering roller at this time in the storage portion as the reference position.

4. The image forming apparatus according to claim 3, wherein the control portion executes the measuring mode after replacing the intermediate transfer belt.

5. The image forming apparatus according to claim 1, wherein the control portion updates the reference position stored in the storage portion during a period from an end of a preceding image forming operation to a succeeding image forming operation.

6. The image forming apparatus according to claim 1, wherein the control portion executes the update of the reference position stored in the storage portion in a case where the intermediate transfer belt is driven by one round or more during the operation in the state in which the transfer biases are applied.

7. The image forming apparatus according to claim 1, wherein the control portion does not execute the update of the reference position stored in the storage portion in a case where a time during which the transfer biases are applied to the first and second transfer members is shorter than a time required for the intermediate transfer belt to rotate by one round or more.

8. The image forming apparatus according to claim 1, wherein the tilting portion includes:

a swing member provided swingably while being connected to a shaft of the steering roller;

a cam member configured to swing the swing member;

a cam driving portion configured to turn the cam member; and a cam position detecting portion as the inclined position detecting portion configured to detect a turning position of the cam member, and wherein the control portion performs meandering control by changing the turning position of the cam member.

9. The image forming apparatus according to claim 8, wherein the cam driving portion is a stepping motor.

10. The image forming apparatus according to claim 1, wherein the control portion executes a measuring mode of executing operations of:

rotating the intermediate transfer belt in the state in which the transfer biases are applied to the first and second transfer members, searching an inclined position of the steering roller in a stabilizing position of the intermediate transfer belt in which a detection result of the belt position detecting portion falls within a predetermined range, and storing the inclined position of the steering roller at the stabilizing position in the storage portion as the reference position.

11. The image forming apparatus according to claim 1, wherein the control portion executes the operation during an adjusting mode in which an image for adjusting toner image is transferred to the intermediate transfer belt and updates the reference position based on an inclined position of the steering roller at this time.

12. An image forming apparatus comprising:

an image carrier;

a rotatable endless intermediate transfer belt on which a toner image is transferred from the image carrier;

a first transfer member configured to transfer the toner image to the intermediate transfer belt while facing the image carrier with the intermediate transfer belt between the first transfer member and the image carrier;

a second transfer member configured to transfer the toner image on the intermediate transfer belt to a recording medium;

a stretch roller and a steering roller rotatably supporting the intermediate transfer belt;

a tilting portion configured to tilt the steering roller;

an inclined position detecting portion configured to detect an inclined position of the steering roller;

a belt position detecting portion configured to detect a position in a width direction orthogonal to a rotating direction of the intermediate transfer belt;

a storage portion configured to store a reference inclined position of the steering roller in a state in which transfer biases are applied to both of the first and second transfer members as a reference position; and a control portion performing a meandering control operation of controlling the widthwise position of the intermediate transfer belt by operating the tilting portion, the control portion tilting the steering roller to the reference position in response to the application of the transfer biases to the first and second transfer members to perform the meandering control operation from the reference position in forming an image, and updating the reference position stored in the storage portion to execute the meandering control operation by using the updated reference position in forming an image in a next time.

* * * * *